US006892970B2

(12) United States Patent
Nussio

(10) Patent No.: US 6,892,970 B2
(45) Date of Patent: May 17, 2005

(54) FUEL INJECTOR HAVING SEGMENTED METAL CORE

(75) Inventor: Randy Nussio, Grand Rapids, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/323,545

(22) Filed: Dec. 18, 2002

(65) Prior Publication Data

US 2004/0118952 A1 Jun. 24, 2004

(51) Int. Cl.[7] ..... B05B 1/30; F02M 51/00

(52) U.S. Cl. ..... 239/585.1; 239/585.2; 239/585.3; 239/585.4; 239/585.5; 239/533.2; 239/533.3; 239/584

(58) Field of Search ..... 239/585.1, 585.2, 239/585.3, 585.4, 585.5, 533.2, 533.3, 583, 584

(56) References Cited

U.S. PATENT DOCUMENTS

| | | | | |
|---|---|---|---|---|
| 2,238,893 A | | 4/1941 | Fischer | |
| 2,774,000 A | | 12/1956 | Ross | |
| 3,260,875 A | | 7/1966 | Evans | |
| 3,999,093 A | | 12/1976 | Kirtley, Jr. | |
| 4,087,711 A | | 5/1978 | Kirtley, Jr. et al. | |
| 4,339,082 A | | 7/1982 | Radaelli et al. | |
| 4,373,671 A | * | 2/1983 | Giardini | 239/585.5 |
| 4,538,130 A | | 8/1985 | Gluckstern et al. | |
| 4,631,809 A | * | 12/1986 | Yokoi | 29/607 |
| 4,653,455 A | * | 3/1987 | Eblen et al. | 123/506 |
| 4,715,332 A | | 12/1987 | Kreuter | |
| 4,783,628 A | | 11/1988 | Huson | |
| 4,810,986 A | | 3/1989 | Leupold | |
| 4,812,889 A | | 3/1989 | Kakumu | |
| 4,822,772 A | | 4/1989 | Huson | |
| D330,541 S | | 10/1992 | Burrow et al. | |
| 5,207,410 A | | 5/1993 | Wakeman | |
| 5,512,872 A | | 4/1996 | Ohashi | |
| 5,515,818 A | * | 5/1996 | Born | 123/90.11 |
| 5,523,546 A | | 6/1996 | Lake | |
| 5,719,469 A | | 2/1998 | Leupold | |
| 6,155,503 A | | 12/2000 | Benson et al. | |
| 6,157,281 A | | 12/2000 | Katznelson et al. | |
| 6,168,135 B1 | | 1/2001 | Fochtman | |
| 6,457,464 B1 | * | 10/2002 | Rapoport et al. | 123/605 |
| 2002/0170986 A1 | * | 11/2002 | Reiger et al. | 239/585.1 |

FOREIGN PATENT DOCUMENTS

| | | | | |
|---|---|---|---|---|
| JP | 57143804 A | * | 9/1982 | H01F/3/02 |

* cited by examiner

*Primary Examiner*—Robin O. Evans
(74) *Attorney, Agent, or Firm*—Brooks Kushman, P.C.

(57) ABSTRACT

An electromagnetic actuator for a fluid pressure control valve in a fuel injector for an internal combustion engine is disclosed. The fuel injector comprises a control module including a fuel pressure control valve; an armature connected to the fuel pressure control valve; and a stator assembly including a magnetic core comprising of at least two segments and a bobbin. The stator assembly, when it is energized by a power source, produces a magnetic field to draw the armature towards the stator assembly.

20 Claims, 3 Drawing Sheets

FUEL INJECTOR HAVING SEGMENTED METAL CORE

BACKGROUND OF THE INVENTION

1. Field of the Invention

The invention relates to a segmented metal core for an electromagnetic actuator for a control valve of a fuel injector for an internal combustion engine.

2. Background Art

Co-pending patent application Ser. No. 10/208,587, entitled "Fuel Injector For Diesel Engines", filed by W. Scott Fischer, David Eickholt and Mike Weston on Jul. 30, 2002, now U.S. Patent 6,758,415, which is assigned to the assignee of the present application, discloses an injector assembly for an internal combustion engine, wherein the control valve and valve actuator are formed as a module that is independent of the pump body and the nozzle assembly. The module, the plunger body and the nozzle assembly are arranged in a linear, stacked relationship. The co-pending application is assigned to the assignee of the present invention.

The control valve in the fuel injector of the co-pending application is closed by applying a voltage to a magnetic circuit having a magnetic core inside the control valve body. The magnetic circuit generates a magnetic flux, which draws the control valve and armature toward the magnetic core.

To open the control valve, the magnetic circuit is demagnetized so that a control valve spring can bias the control valve to its open position. Terminating the applied voltage begins the demagnetization process as the magnetic flux lines decay rapidly. When the magnetic flux lines have sufficiently decayed, the control valve spring overcomes the attractive force of the magnetic circuit and opens the control valve.

In the creation of the magnetic flux, eddy currents are induced in the electrically conductive magnetic material. The eddy currents are detrimental to the performance of the of the magnetic core since they contribute to slow response and energy loss by slowing down the demagnification process. Accordingly, it is desirable to minimize the induced eddy currents.

Past solutions to reducing eddy currents in fuel injectors include designing the magnetic core with stacked, thin laminate material and providing grooves or slots in the magnetic poles. The grooves or slots decrease eddy currents by increasing the length and resistance of the eddy current flow path.

Round magnetic cores have many advantages over other shaped cores in the creation of magnetic flux. However, laminate structures cannot effectively be formed into round magnetic cores. Manufacturing magnetic cores having slots, furthermore, creates a multitude of manufacturing issues which lead to increased downtime and maintenance.

SUMMARY OF THE INVENTION

The present invention discloses an electromagnetic actuator for a fluid pressure control valve in a fuel injector for an internal combustion engine. The fuel injector comprises a control module including a fuel pressure control valve, an armature connected to the fuel pressure control valve, and a stator assembly including a magnetic core comprising at least two segments and a bobbin. The stator assembly is electrically connected to a power source and, when energized, produces a magnetic field to draw the armature towards the stator assembly.

Prior art fuel injectors have induced eddy currents, which are detrimental to the performance of the fuel injector because they reduce response time to open the control valve. The present invention reduces the formation of eddy currents by providing a segmented magnetic core. Preferably, the segmented magnetic core is round and comprises wedge shaped segments. However, other shapes are possible depending on the application.

The segments may be electrically isolated further by allowing a natural oxide to form on the segment contact surfaces that abut adjacent segments. Further electrical isolation is possible by coating the segment contact surfaces with a nonconductive coating and/or by roughening the segment contact surfaces.

The present invention minimizes the eddy currents by providing an electro-mechanical fuel injector having a magnetic core comprising multiple segments.

DETAILED DESCRIPTION OF THE PREFERRED EMBODIMENT(S)

Figure 1:
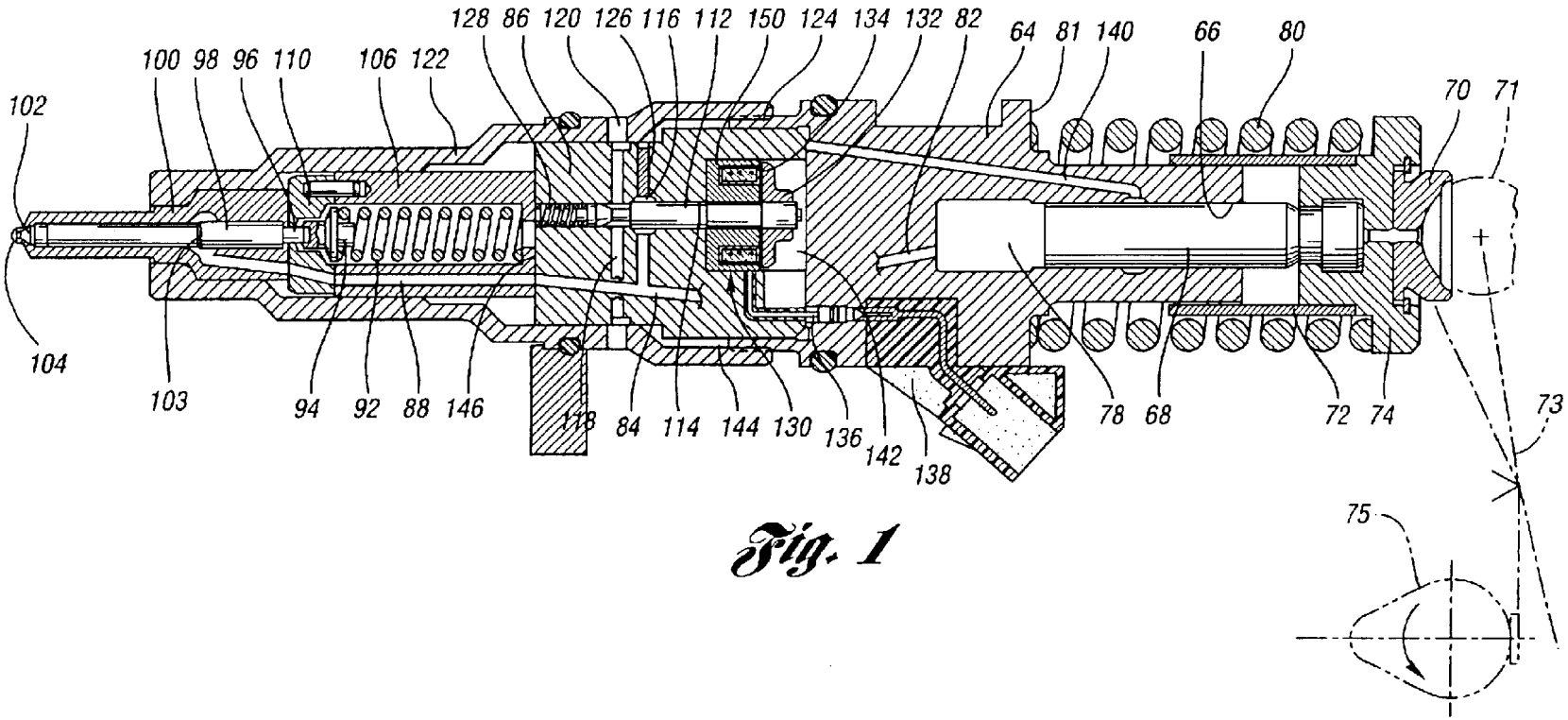
FIG. 1 is a cross-sectional view showing the overall assembly of an injector that incorporates the segmented magnetic core of the present invention.

Referring now to the drawings, the injector assembly of the present invention includes a relatively small pump body 64. A central pumping cylinder 66 in body 64 receives plunger 68. A cam follower assembly 70 includes a follower sleeve 72 and a spring seat 74. The follower assembly 70 is connected to the outer end of plunger 68. The cylinder 66 and plunger 68 define a high-pressure cavity 78. The plunger is urged normally to an outward position by plunger spring 80, which is seated on the spring seat 74 at the outer end of the plunger. The inner end of the spring is seated on a spring seat shoulder 81 of the pump body 64.

The cam follower 70 is engageable with a surface 71 of an actuator assembly shown at 73, which is driven by engine camshaft 75 in known fashion. The stroking of the piston creates pumping pressure in chamber 78, which is distributed through an internal passage 82 formed in the lower end of the body 64. This passage communicates with the high-pressure passage 84 formed in the control valve module 86. The opposite end of the passage 84 communicates with high-pressure passage 88 in a spring cage 106 for needle valve spring 92.

The spring 92 engages a spring seat 94, which is in contact with the end 96 of a needle valve 98 received in a nozzle element 100. The needle valve 98 has a large diameter portion and a smaller diameter portion, which define a differential area 103 in communication with high-pressure fluid in passage 88. The end of the needle valve 98 is tapered, as shown at 102, the tapered end registering with a nozzle orifice 104 through which fuel is injected into the combustion chamber of the engine with which the injector is used.

When the plunger 68 is stroked, pressure is developed in passage 88, which acts on the differential area of the needle valve and retracts the needle valve against the opposing force of needle valve spring 92, thereby allowing high-pressure fluid to be injected through the nozzle orifice. Spring 92, located in the spring cage 106, is situated in engagement with the end of the pocket in the spring cage occupied by spring 92. A spacer 110, located at the lower end of the spring cage 106, positions the spring cage with respect to the nozzle element 100. A locator pin can be used, as shown in FIG. 1, to provide correct angular disposition of the spacer 110 with respect to the spring cage 106.

Figure 2:
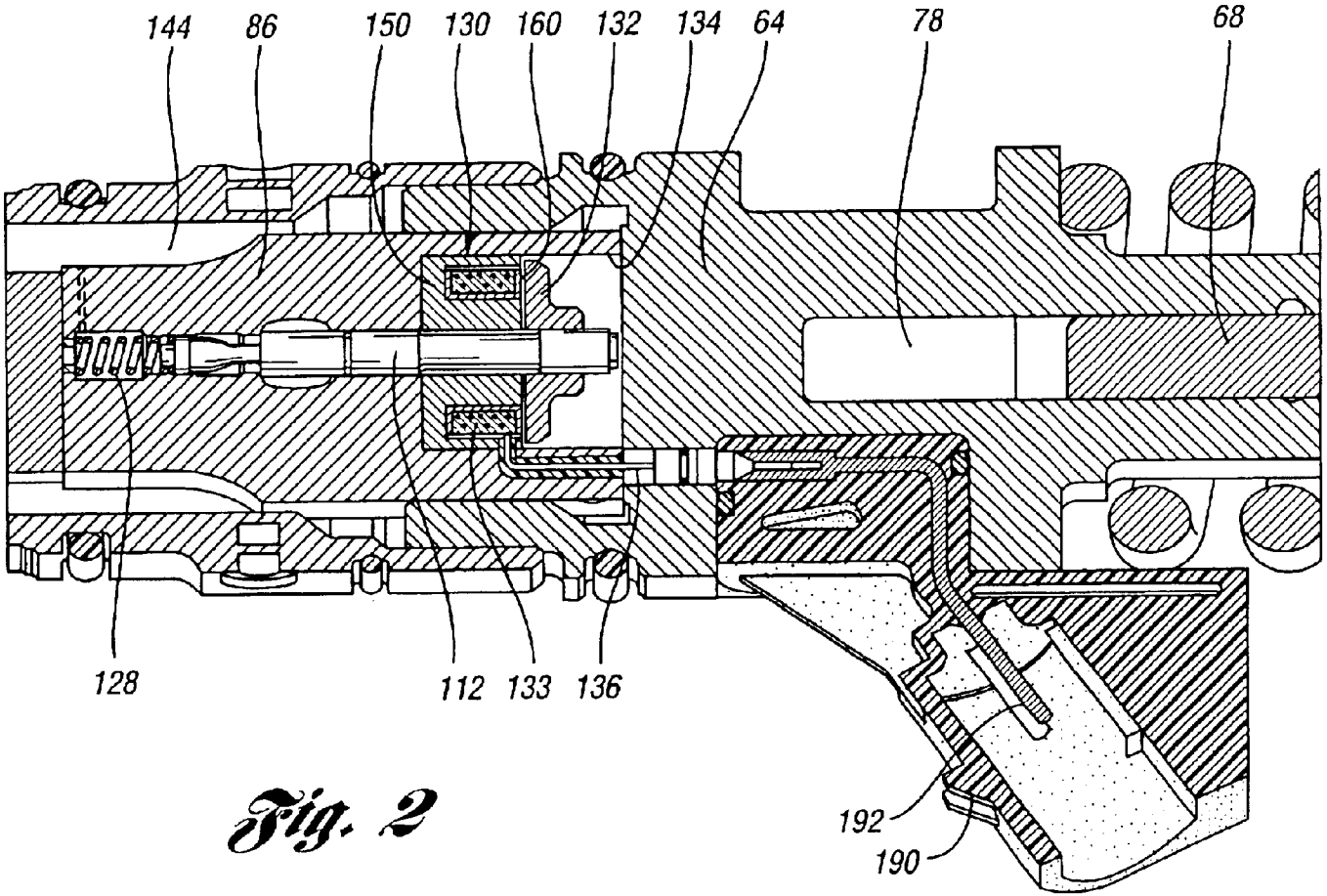
FIG. 2 is an enlarged partial cross-sectional view showing the segmented magnetic core of the present invention.

A control valve 112 is located in a cylindrical valve chamber 114. A high-pressure groove 116 surrounding the valve 112 is in communication with high-pressure passage 84. When the valve is positioned as shown in FIG. 2, the valve 112 will block communication between high-pressure passage 84 and low-pressure passage or spill bore 118, which extends to low-pressure port 120 in the nozzle nut 122.

The nozzle nut 122 extends over the module 86. It is threadably connected at 124 to the lower end of the cylinder body 64.

The connection between passage 84 and groove 116 can be formed by a cross-passage drilled through the module 86. One end of the cross-passage is blocked by a pin or plug 126.

The end of control valve 112 engages a control valve spring 128 located in module 86. This spring tends to open the valve to establish communication between high-pressure passage 84 and low-pressure passage 118 thereby decreasing the pressure acting on the nozzle valve element.

A valve 112 carries an armature 132, which is drawn toward stator assembly 130 when the windings of the stator are energized, thereby shifting the valve 112 to a closed position and allowing the plunger 68 to develop a pressure pulse that actuates the nozzle valve element. The stator assembly comprises a magnetic core 150 and windings 133.

The stator assembly 130 is located in a cylindrical opening 134 in the module 86. The valve 112 extends through a central opening in the stator assembly. The windings of the stator assembly extend to an electrical terminal 136, which in turn is connected to an electrical connector assembly 138 secured to the pump body 64. This establishes an electrical connection between a wiring harness for an engine controller (not shown) and the stator windings 133.

A low-pressure passage 140 is formed in the cylinder body 64. It communicates with a low-pressure region 142 at the stator assembly and with a low-pressure region 144, which surrounds the module 86. Fluid that leaks past the plunger 68 during the pumping stroke is drained back through the low-pressure passage 140 to the low-pressure return port 120.

The interface of the upper end of the spring cage 106 and the lower end of the module 86 is shown at 146. The mating surfaces at the interface 146 are precisely machined to provide flatness that will establish high-pressure fluid communication between passage 88 and passage 84.

The interface between the upper end of the module 86 and the lower end of the pump body 64 is shown in FIG. 2. The upper surface of the module 86 and the lower surface of the pump body 64 are precisely machined to establish high-pressure fluid distribution from passage 82 to passage 84. The seal established by the mating precision machined surfaces at each end of the module 86 eliminates the need for providing fluid seals, such as O-rings. Alternatively, seals may also be used.

The pump body 64, the module 86, the spring cage 106 and the nozzle element 100 are held in stacked, assembled relationship as the nozzle nut 122 is tightened at the threaded connection 124. The module, the spring cage and the nozzle element can be disassembled readily merely by disengaging the threaded connection at 124, which facilitates servicing and replacement of the elements of the assembly.

The windings 133 of the stator assembly 130 encircle a bobbin 160. The windings 133 are wound about the bobbin 160 with a winding machine. The windings 133 are electrically connected to connectors 136, which in turn are electrically connected to conductors 192 in a conductor assembly 190 as is known in the art and shown, for exemplary purposes only, in co-pending patent application Ser. No. 10/197,317, filed Jul. 16, 2002, now U.S. Pat. No. 6,565,020, which is assigned to the assignee of the present application.

The valve spring 128 biases the control valve 112 to an open position. To close the control valve 112, the windings 133 are energized thereby producing a magnetic field, which travels axially and attracts the armature 132 towards the stator assembly 130, overcoming the force of the valve spring 128.

In order to open the control valve 112, the stator assembly 130 must be de-energized by removing the voltage applied to the windings 133, allowing the magnetic field to collapse. When the magnetic field sufficiently decreases, the valve spring 128 biases the armature 132 away from the stator assembly 130, thereby opening the control valve 112.

Figure 3:
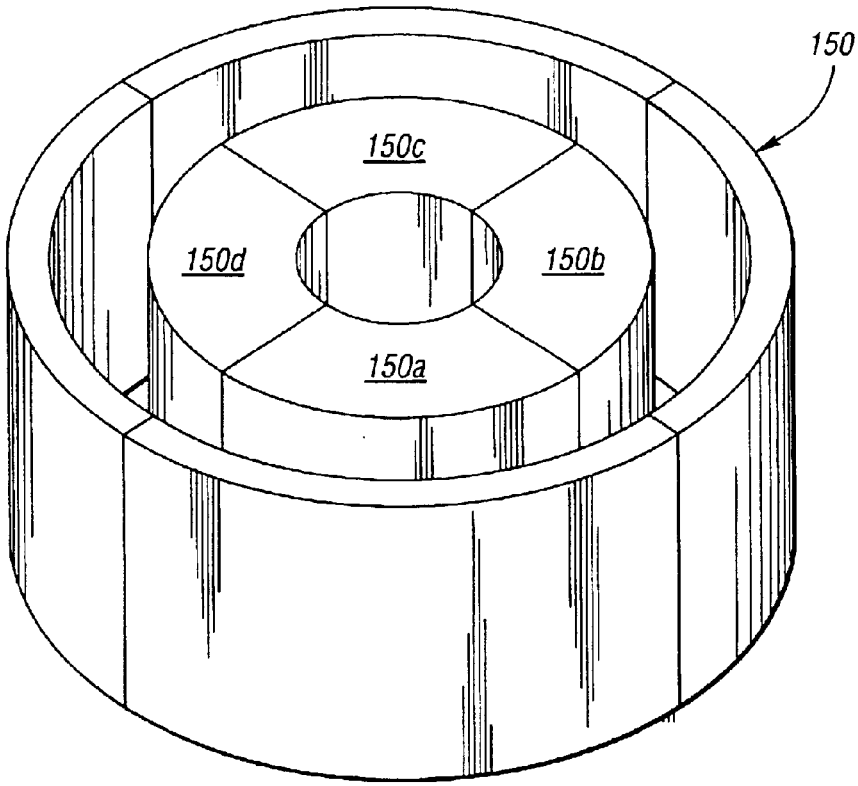
FIG. 3 is a perspective view of the segmented magnetic core of the present invention.
Figure 4:
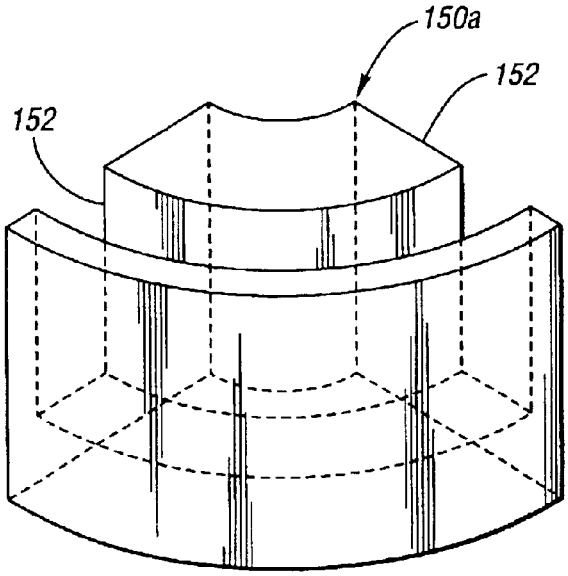
FIG. 4 is a perspective view of one segment of the segmented magnetic core of the present invention.

A detail of one embodiment of the magnetic core 150 is illustrated in FIG. 3. A magnetic core sub-assembly 150 is shown as having four segments 150*a*, 150*b*, 150*c*, 150*d*, although the invention may have a core comprising a minimum of two segments or a maximum number of segments limited only by available technology, the size of the core, and the desired magnetic performance. The. segments 150*a*, 150*b*, 150*c*, 150*d* may be held together by the windings 133 or bobbin 160, by encapsulating the entire integrated magnetic core 150 with a polymer, or by an adhesive. Also, as shown, the integrated magnetic core sub-assembly 150 is illustrated as being round and having wedge-shaped segments. A round magnetic core is the preferred shape for the creation of magnetic flux. The magnetic core and segments could, however, be shaped otherwise for different applications.

The magnetic core sub-assembly 150 may be manufactured by machining. However, the preferred manufacturing process uses powder metal forming with a high magnetic saturation alloy.

In the preferred embodiment, the segments are wedge-shaped sections wherein a segment contact surface 152 contacts a segment contact surface of an adjacent segment or segments at an interface having high electrical resistance. Naturally occurring oxide films may form on the individual segment contact surfaces and prevent pure metal to metal contact at the interface. The natural oxides formed on the segment contact surfaces 152 of the segments sufficiently reduce the eddy currents for certain applications.

In certain applications, such as high frequency excitation, further reduction of the eddy currents is desirable. In these circumstances, the wedge angle may be reduced and the number of segments increased. The electrical isolation of each segment can be increased by coating one or more segment contact surfaces 152 of the segments with an electrically nonconductive film. As an alternative to or in combination with the film coating, one or more segment contact surfaces 152 can be intentionally roughened to further create electrical resistance and isolation.

The segments of the present invention have advantages over slots because the segments do not create a reduction in the magnetic pole area. Further, segments have the advantage of interrupting the current path over the entire cross section. Slots, in contrast, must stop before cutting through the core and thus still allow a current path.

As mentioned above, the segments may be machined, although powder metal forming is the preferred method of making the segments. Although slots may also be powder metal formed, the segments with slots require thin cross sections in the forming tool, which easily deform and break thereby increasing tool maintenance and downtime. Using thicker slots to decrease machine downtime reduces the magnetic surface area resulting in reduced attractive force.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electromagnetic actuator for a fluid pressure control valve in a fuel injector for an internal combustion engine, the electromagnetic actuator comprising:

a control module including a fuel pressure control valve;

an armature connected to the fuel pressure control valve; and a stator assembly including a magnetic core sub-assembly comprising at least two segments and a bobbin with electrical windings, the stator assembly being electrically connected to a power source, the stator assembly being energizable to produce a magnetic field to draw the armature towards the stator assembly;

the segments being integrated and assembled together to define the magnetic core sub-assembly, the bobbin windings encircling the core sub-assembly;

each segment having contact surfaces engageable with contact surfaces of an adjacent segment, a contact surface of each segment engaging a contact surface of an adjacent segment at an interface having high electrical resistance whereby core eddy currents in the core sub-assembly are reduced.

2. The actuator of claim 1 wherein the magnetic core comprises four segments.

3. The actuator of claim 1 wherein the segments are wedge-shaped.

4. An electromagnetic actuator for a fluid pressure control valve in a fuel injector for an internal combustion engine, the electromagnetic actuator comprising;

a control module including a fuel pressure control valve;

an armature connected to the fuel pressure control valve; and a stator assembly including a magnetic core sub-assembly comprising at least two segments and a bobbin with electrical windings, the stator assembly being electrically connected to a power source, the stator assembly being energizable to produce a magnetic field to draw the armature towards the stator assembly;

the segments being integrated and assembled together to define the magnetic core sub-assembly, the bobbin windings encircling the core sub-assembly;

each segment having contact surfaces engageable with contact surfaces of an adjacent segment, a contact surface of the segment engaging a contact surface of an adjacent segment at an interface having high electrical resistance whereby core eddy currents in the core sub-assembly are reduced; and an electrically nonconductive film being applied to one or more contact surfaces prior to assembly of the magnetic core to increase the electrical isolation of the individual segments.

5. The actuator of claim 1 wherein each segment has contact surfaces that engage contact surfaces on adjacent segments and wherein one or more contact surfaces have a rough finish to create electrical resistance.

6. The actuator of claim 1 wherein the segments are formed by powder metal forming operations.

7. The actuator of claim 1 wherein the magnetic core is circular.

8. The actuator of claim 1 further comprising a valve spring to bias the control valve away from the stator.

9. A fuel injector comprising:

a control valve housing having a control valve attached to an armature;

a valve spring biasing the control valve towards a first position; and an electrically operable stator assembly having a magnetic core sub-assembly comprising at least two segments and windings wherein the windings, when energized, attract the armature and control valve towards the stator and into a second position;

each segment having contact surfaces engageable with contact surfaces of an adjacent segment, a contact surface of one segment engaging a contact surface of an adjacent segment at an interface having high electrical resistance whereby eddy currents in the core sub-assembly are reduced.

10. The fuel injector of claim 9 wherein the magnetic core comprises four segments.

11. The fuel injector of claim 10 wherein the segments are wedge-shaped.

12. A fuel injector comprising:

a control valve housing having a control valve attached to an armature;

a valve spring biasing the control valve towards a first position; and an electrically operable stator assembly having a magnetic core sub-assembly comprising at least two segments and windings wherein the windings, when energized, attract the armature and control valve towards the stator and into a second position;

each segment having contact surfaces engageable with contact surfaces of an adjacent segment, a contact surface of one segment engaging a contact surface of an adjacent segment at an interface having high electrical resistance whereby eddy currents in the core sub-assembly are reduced;

each segment having contact surfaces that engage contact surfaces of adjacent segments; and an electrically nonconductive film applied to one or more contact surfaces prior to assembly of the magnetic core to increase electrical isolation of the individual segments.

13. The fuel injector of claim 9 wherein the contact surfaces have a rough finish to create electrical resistance.

14. The fuel injector of claim 9 wherein the segments are formed by powder metal forming operations.

15. The fuel injector of claim 9 wherein the magnetic core is circular.

16. The fuel injector of claim 9 wherein the magnetic core has an aperture therethrough, the control valve extending through the armature.

17. The electromagnetic actuator set forth in claim 1 including means for securing the segments together in the stator assembly.

18. The electromagnetic actuator set forth in claim 17 wherein the means for securing the segments together in the stator assembly comprise the bobbin.

19. The electromagnetic actuator set forth in claim 9 including means for securing the segments together in the stator assembly.

20. The electromagnetic actuator set forth in claim 19 wherein the means for securing the segments together comprise the windings.

* * * * *